US006523502B1

(12) United States Patent
Hughes

(10) Patent No.: US 6,523,502 B1
(45) Date of Patent: Feb. 25, 2003

(54) EXFOLIATED MAGNETITE REMOVAL SYSTEM AND CONTROLLABLE FORCE COOLING FOR BOILERS

(75) Inventor: Adrian Robert Hughes, Biloela (AU)

(73) Assignee: C S Energy Ltd, Brisbane (AU)

( * ) Notice: Subject to any disclaimer, the term of this patent is extended or adjusted under 35 U.S.C. 154(b) by 0 days.

(21) Appl. No.: 09/787,874

(22) PCT Filed: Sep. 23, 1999

(86) PCT No.: PCT/AU99/00799

§ 371 (c)(1),
(2), (4) Date: Mar. 22, 2001

(87) PCT Pub. No.: WO00/17576

PCT Pub. Date: Mar. 30, 2000

(30) Foreign Application Priority Data

Sep. 23, 1998 (AU) ..... PP6100
Jan. 8, 1999 (AU) ..... PP8060

(51) Int. Cl.[7] ..... F28G 1/00
(52) U.S. Cl. ..... 122/379; 122/380; 122/390
(58) Field of Search ..... 122/379, 380, 122/390; 134/22.12, 22.18, 37

(56) References Cited

U.S. PATENT DOCUMENTS

| | | | | |
|---|---|---|---|---|
| 4,581,074 | A | 4/1986 | Mantina et al. | |
| 4,645,542 | A | 2/1987 | Scharton | |
| 4,655,846 | A | 4/1987 | Scharton | |
| 4,735,175 | A | 4/1988 | Kauisvesi | |
| 6,178,925 | B1 * | 1/2001 | Sturm et al. | 122/390 |

FOREIGN PATENT DOCUMENTS

| | | |
|---|---|---|
| WO | WO 94/29662 | 12/1994 |

* cited by examiner

*Primary Examiner*—Jiping Lu
(74) *Attorney, Agent, or Firm*—Hudak, Shunk & Farine Co. LPA

(57) ABSTRACT

A method of controllable cooling of a boiler (10) and removing exfoliated magnetite from the boiler tubes (30, 31) employs flowing dry gas through the boiler tubes (30, 31) at a flow velocity above the terminal velocity of the magnetite flakes as the boiler (10) is cooled from a temperature above the temperature at which exfoliation occurs. A method of removing magnetite blockages (100) from boiler tubes (30, 31) is also disclosed.

17 Claims, 3 Drawing Sheets

EXFOLIATED MAGNETITE REMOVAL SYSTEM AND CONTROLLABLE FORCE COOLING FOR BOILERS

BACKGROUND OF THE INVENTION

1. Field of the Invention

THIS INVENTION relates to a method of, and apparatus for, purging loose magnetite from boilers. The invention is particularly suitable for, but not limited to, removing exfoliated magnetite from the bends and inner bores of chromium stainless steel boiler tubes.

2. Prior Art

Chromium stainless steel superheater and reheater tubes, which operate in a high steam temperature environment for extended periods, develop a two-part oxide layer on the inner bore of the tubes. The oxide, which is given the general name "magnetite", is characterised by two distinct phases—an outer layer (closest to the tube centre) which is iron rich, and an inner layer which is chrome rich. The two layers have very different coefficients of expansion. The process of cooling out the boiler induces large stresses between the two oxides. At metal temperatures of approximately 90°–150° C., the outer layer of magnetite oxide tends to delaminate from the tightly adhering inner layer and parent metal.

Exfoliation of this outer layer and a small amount of inner layer causes magnetite to fall and partially or totally block the bottom of vertical or pendant superheaters and reheaters. Once a total blockage occurs in a tube, the steam flow paths being established in a boiler as it builds steam pressure bypass this blocked tube (due to small differential pressures within parallel paths of the superheater/reheater pendants). The lack of cooling steam causes overheating of this blocked tube leg and results in failure of the tube through short term overheating. The time and point of failure is often not detected.

Rupture of a single tube results in that tube moving violently amongst neighbouring tubes. This permits other tubes to become damaged and potentially rupture. Steam impingement on nearby tube walls becomes another mechanism of failure. Eventually, so much steam will be lost to the gas path side of the boiler that a gas side pressure excursion will remove the boiler from service, or the boiler feed pumps will not maintain the condensate feed. Several weeks may be required to repair the damage from several hours of damage caused by a ruptured tube.

Callide, Tarong and Stanwell Power Stations in the State of Queensland, Australia, have superheaters that are vertical pendants made of 321 stainless steel, and operate at high metal temperatures (believed to be 580°–640° C.) for extended periods. The combination causes a large amount of magnetite exfoliation to occur during boiler cool downs.

To ensure that a tube does not rupture on the boiler's return to service, the traditional practice is to:

(a) allow the boiler to cool out using the draft fan groups;

(b) build a scaffold access to the superheater bends;

(c) x-ray all superheater loops;

(d) cut and clean all tubes which have more than a 50% section area blockage;

(e) re-weld all cut tubes and check the weld quality with x-rays; and (f) remove the scaffold and return the boiler to service.

There still remains some risk that further falls of magnetite and possible tube blockage will occur in the loops after the initial x-rays and scope of work have been completed. This phenomenon can possibly occur due to high stresses continuing to undergo relaxation in the outer layer magnetite, the initially wet tube drying and the magnetite flakes losing their adhesion sites on the tube bore, and the action of pumping water into the superheater loops for a boiler pressure test. Case studies of Japanese boiler plants show the need to x-ray, cut and clean tubes up to three times in the same boiler shutdown.

Options suggested to stop or significantly reduce the effects of magnetite exfoliation include:

(a) replace the stainless steel boiler tube with material that exhibits a lower tendency to produce exfoliating magnetite. Retrofitting a 350MW boiler with new tube is estimated to cost as least $(AU)5M in materials and labour. A significant additional cost may be the loss of availability of the boiler;

(b) operate the boiler at a lower steam temperature (eg, below 530° C. main steam temperature). The rate of formation of magnetite at this temperature is very much slower. The trade-off is the resulting efficiency loss;

(c) cycle the boiler so that only small amounts of magnetite exfoliation occur between boiler cool downs. This is a very costly exercise due to the significant start-up fuel costs and life expended on metal components. (The boiler materials have a finite life due to stress cycles induced by the cooling down and heating up process);

(d) perform a chemical clean on the superheaters so as to strip off the outer layer of magnetite and leave intact the inner layer to act as an impediment to the further migration of iron and the resulting formation of the outer layer of magnetite. Performing a chemical clean costs approximately $(AU)300,000 and requires at least fifteen lost generation days. Callide and Tarong units have undergone chemical cleans on the superheaters. Magnetite shredding after these chemical cleans at Callide were greater in quantity than that seen prior to the chemical cleans. Doubt exists as to the effectiveness of this method of controlling exfoliating magnetite;

(e) create a flow path for the magnetite to be expelled from the superheater loops. Devising a flow path exit for exfoliating magnetite is attractive due to its minimal once off capital cost, low technology, simplicity, speed of performance and repeatability.

One prior art suggestion proposed to generate a flow path for exfoliated magnetite is by "backwashing" the superheater loops using water filled loops and compressed air to drive water and magnetite from the loops. This process has the disadvantage that the exfoliated magnetite is distributed upstream of the superheater loops, and is not removed from the boiler. It is suspected that when the boiler is recommissioned, the magnetite distributed in the boiler is not completely removed during the initial steam purges and can later cause impingement damage to the turbine components and control valves.

The prior art suggestion referred above utilises a reservoir for the compressed air/steam, introduces the compressed media to the water/magnetite solution and drives the water/magnetite slug from the superheater loops. The water/magnetite slug is initially at atmospheric pressure. Upon opening the compressed media reservoir, the water interface nearest the reservoir experiences a sudden pressure rise. This transient wave propagates through the water to the magnetite slug. The slug is compressed and radial frictional forces are significantly increased. The removal of a magnetite slug completely filling a tube bore can only happen if the pressure wave can overcome the frictional resistive forces. A critical length of magnetite slug exists whereby a nominal pressure transient will not move the slug of magnetite. A boiler tube failure at Tarong Power Station (Unit 2, February 1999), soon after a boiler restart, has been attributed to the inability of the prior art suggestion's water/air purging technique.

The cooling down of boilers, for maintenance/repairs is another major problem.

Large capacity, high-pressure boilers found in power generation plants have numerous headers to mix and redirect the steam path. Additionally, these boilers can have one or more drums or separators. These vessels are typically made of carbon steel or alloy materials and have 40 mm–140 mm thick walls. This produces a high metal volume to surface ratio that makes cooling of the vessels difficult.

Forced outages or planned outages (shut downs) occur on boilers to enable rectification work to be performed or statutory inspections to be fulfilled. Some of this work is conducted on, in, or near the above vessels. It is typical to require a waiting time of 4–8 days for thick walled vessels to be cool enough for personnel to have skin contact. The 350 MW units at Callide Power Station, Queensland, Australia, require 4–6 days before the tertiary superheater header metal temperatures fall below 100° C. when employing a cooling mode of natural convection assisted by boiler fan groups.

The cooling time is lengthened if the units are not fired down to very low pressures, the fan groups on the gas side are not utilised to cool the superheater/reheater pendants, waterwalls and roof tubes, or large amounts of ash collect in the heater vestibule and insulate the lagged headers. The cost of waiting several days for drums and headers to cool is significant. A reduction in this waiting time through the use of a controlled forced cooling method for these vessels would be of value to boiler owners.

SUMMARY OF THE PRESENT INVENTION

It is an object of the present invention to provide a method to significantly reduce the amount of magnetite initially lodging in the boiler tube bends during the cool down process.

It is a preferred object of the present invention to effectively remove all magnetite slugs from boiler tube bends in the event that a magnetite blockage exists. The method described as part of this invention is superior to the prior art suggestion in that the advocated method causes a significant decrease in the initial frictional resistive forces experienced by the removal of a magnetite slug by the prior art suggestion. The method hereinafter described will thus permit a longer critical length of magnetite slug to be removed than by the prior art suggestion. Additionally, the present method overcomes some deficiencies of the known water/compressed air method. The present method will be shown to be a preferred alternative for exfoliated magnetite removal in superheaters or reheaters.

It is a further preferred object of the present invention to provide a method of purging exfoliated magnetite from boiler superheater loop(s) which is relatively simple, inexpensive and be performed within a minimal amount of time.

It is a still preferred object to provide a method where the magnetite is expelled from the boiler.

It is a still further preferred object to provide a dry gas flow in the tube bore during the cool down of the boiler—this dry gas should preferably be flowing at a rate above the terminal velocity of the magnetite flakes so that the flakes will be removed from the boiler as they exfoliate.

It is a still further preferred object to provide a method to rapidly and controllably cool the boiler to ambient temperatures using forced convection.

It is a still further preferred object to provide a method where the rate at which the cooling medium flows through the boiler is controlled so that the temperature gradient of boiler metal does not exceed preset limits.

It is a still further preferred object to provide a method where magnetite slugs are expelled from boiler tube loops by releasing a compressed gas such as air, nitrogen, dry steam, oxygen or carbon dioxide.

It is a still further preferred object to provide a method where the boiler superheater tube bores are left in a dry state to prohibit flash rusting or similar corrosion states. Additionally, exfoliated magnetite flakes have a weaker bonding force to the tube bore in the dry state. Removal of the flakes can be accomplished more easily in the dry state rather than wet.

It is a still further preferred object to purge all magnetite containing superheater or reheater tube paths simultaneously.

It is a still further preferred object to provide apparatus for the method using equipment that is readily available.

Other preferred objects will become apparent from the following description.

The present invention, in different aspects, broadly encompasses:

(a) rapidly, but controllably force, cooling of all boiler metal to ambient temperatures to enable early access to the boiler for maintenance work;

(b) avoiding superheater/reheater tube blockages caused by exfoliated magnetite through the means of introducing a gas flow in the boiler tubes to carry the exfoliating material out of the boiler. This process of removal occurs during the cool down of the boiler metal and as the magnetite flake leaves the exfoliation site;

(c) remove superheater/reheater tube blockages caused by exfoliated magnetite in the event that they do form. This aspect of the invention uses a compressible gas that has been stored under pressure within the boiler tubes containing the exfoliated magnetite. The gas is suddenly released, preferably from a point near the site of the magnetite tube blockages. The sudden pressure drop causes the magnetite slug to be expelled from the boiler tube loops. Several iterations of the gas pressurisation/depressurisation may be required to remove long slugs of magnetite or slugs of magnetite in series.

In one aspect the present invention resides in a method of controllable force cooling a boiler and removing exfoliated magnetite from at least one boiler heater tube in the boiler, the method including the steps of:

after the boiler is fired down, depressurised and drained of water, and while the temperature(s) of the boiler tube(s) exceeds the temperature at which magnetite exfoliates, introducing a dry gas flow into the boiler water/steam side of the boiler to (i) initially remove wet steam and prohibit condensation collecting in superheater loops in the boiler heater tube(s), and (ii) then promote the dry gas flow in the boiler heater tube(s) where magnetite exfoliation exists, where the flow velocity of the dry gas exceeds the terminal velocity of flakes of the magnetite exfoliated so as to cause the flakes to be expelled from the boiler.

Preferably the boiler tube temperature is above 150° C.

Preferably the flow velocity of the dry gas exceeds 4.5 m/s. (meters/seconds).

Preferably the dry gas flow is maintained, in step (ii), until the boiler tube(s) temperature(s) are below the temperature at which magnetite exfoliation occurs. Preferably the boiler tube(s) temperature(s) are below 50° C.

Preferably the dry gas flow is at high pressure to promote surface heat transfer between the wall(s) of the boiler tube(s) and the dry gas.

Preferably the dry gas is introduced into the coldest portions of the boiler tube(s) to minimise thermal stress.

Preferably, the dry gas is air, nitrogen, dry steam, oxygen, carbon dioxide or two or more of these in a mixture.

In a second aspect the present invention resides in a method for removing magnetite blockage(s) from at least one boiler tube in a boiler, including the steps of;

a) operably connecting a quick opening valve to the boiler tube(s);

b) slowly pressurising the boiler tube(s) with dry gas enabling the dry gas to be entrained between flakes of the magnetite during the pressurisation phase; and c) rapidly opening the valve to cause a negative gas pressure transient to propagate back to the magnetite blockage(s), to cause the magnetite blockage(s) to be fluidised and be drawn out the boiler tube(s) by flow of the dry gas out the valve.

Steps (b) and (c) may be repeated one or more times to remove all the magnetite.

Preferably the boiler tube(s) are pressurised to 650–1200 KPa. The dry gas may be initially compressed to eg, 650 KPa and be further compressed by water pumped through boiler feed pump(s).

Preferably in step (c), the valve opening time is no longer than 0.5 seconds.

In third and fourth aspects, the present invention resides in the apparatus for effecting the methods of the first and second aspects, respectively.

BRIEF DESCRIPTION OF THE DRAWINGS

To enable the invention to be fully understood, reference is made to the accompanying drawings, in which.

DETAILED DESCRIPTION OF THE PREFERRED EMBODIMENTS

Two distinct methods to remove a magnetite slug from a fully blocked tube will be described. The purpose of the following description is to illustrate the superior method of the present invention.

(1) PRIOR ART

Figure 1:
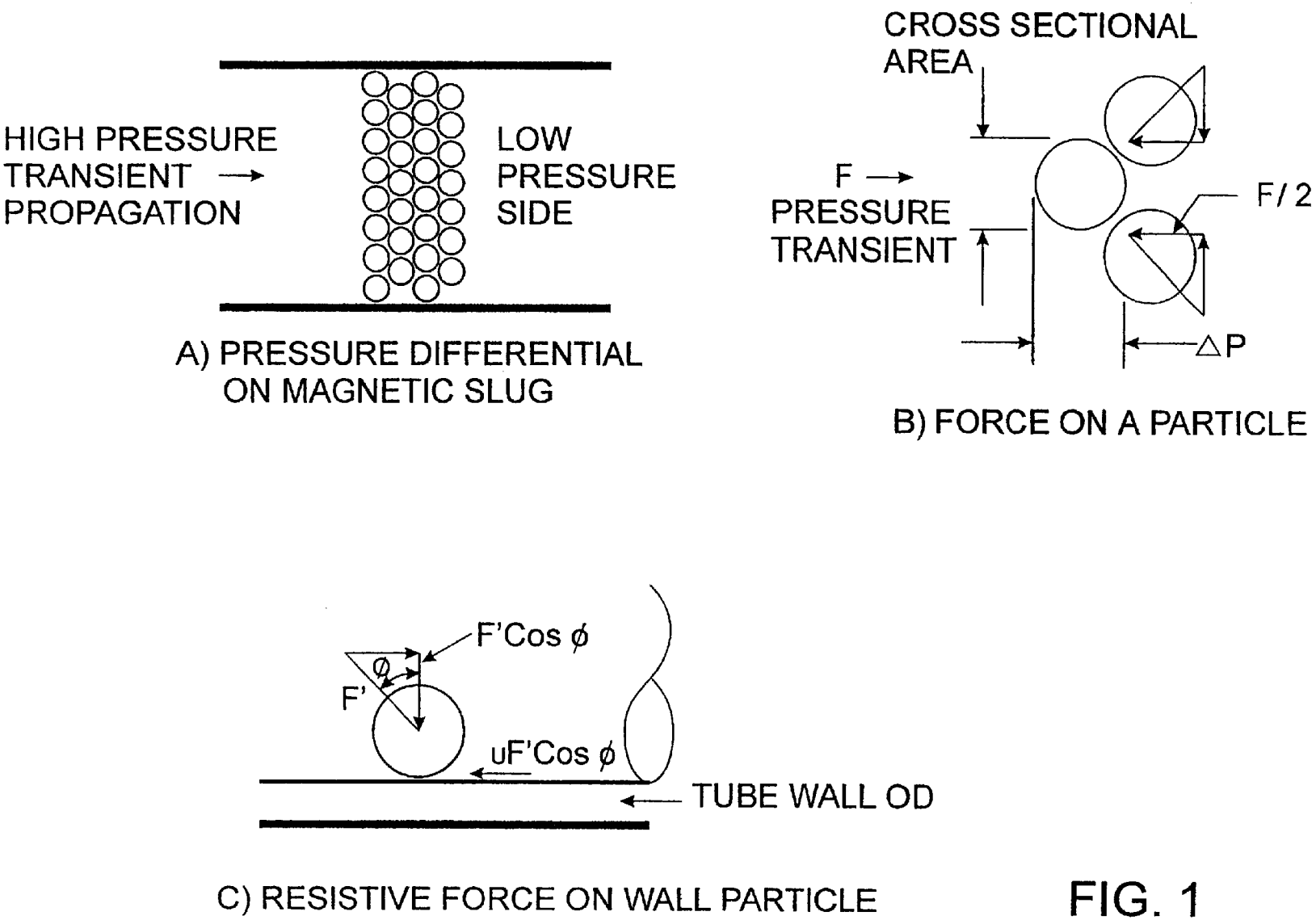
FIG. 1 illustrates the forces acting on a magnetite blockage, from a sudden pressurisation, in the prior art method.

The prior art method of magnetite removal is described with reference to FIG. 1.

A fully blocked magnetite slug, which has a compressed gas supply suddenly introduced to one end, will have a high and low-pressure side. If the medium confronted by the compressed gas is water and magnetite, a high-pressure front will propagate through the water and impact the slug. The magnetite slug is made of discrete particles that block or divide the air or water pressure front. A single magnetite particle can be idealised as a ball. This particle experiences a force from the pressure front equal to (the change in pressure across the particle x cross-sectional area).

Point contact forces of an equal magnitude and opposite sign are generated by the magnetite particle on neighbouring particles. A force system is present which transfers a load normal (radial) to the tube wall. A resistive frictional force results from the normal load. The magnetite slug remains in place when the sum of frictional forces from contact with the wall are greater than the force generated by the pressure front acting over the cross-sectional area of the magnetite slug. The longer the magnetite slug, the greater are the accumulated fictional forces and the higher the pressure front that is required to remove the slug.

(2) PRESENT INVENTION

Figure 2:
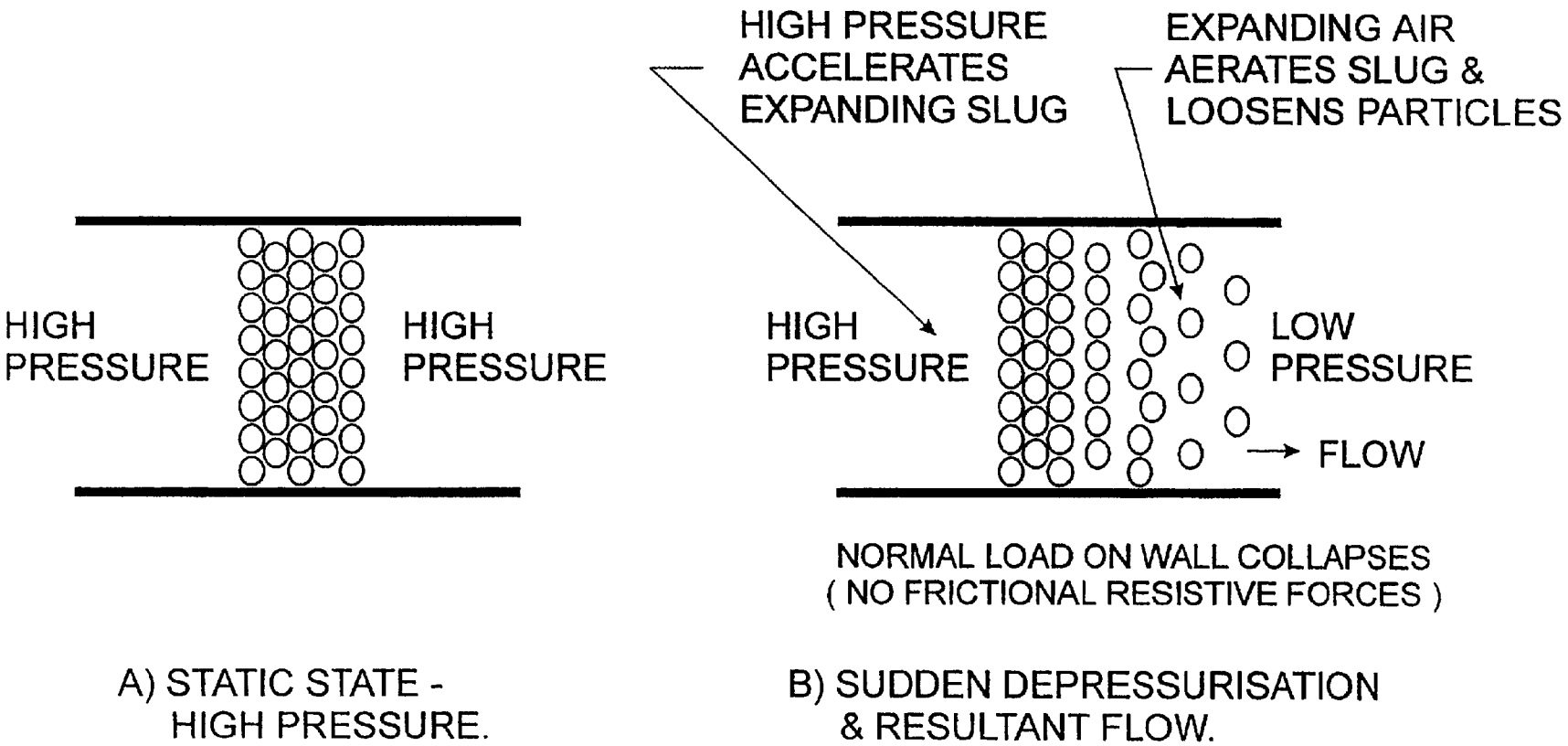
FIG. 2 illustrates the aeration of a blockage from sudden depressurisation, in accordance with the present invention.

The method of the present invention to remove magnetite slugs from boiler heater loops, described with reference to FIG. 2, involves the sudden release of gas from the steam space containing the magnetite. A dry gas can be slowly introduced into a dry magnetite slug, allowing permeation of the gas (eg, air) amongst the particles. The system is pressurised to approximately 650–1200 KPa. Pressurised gas exists on either side of the magnetite slug and within the spaces between the particles of the loose packed medium. A previously installed quick opening valve, connected to a common header, is operated to permit the sudden loss of pressure in the common header and a resulting pressure differential across each of the parallel paths of the boiler heater bends.

The gas contained in the spaces between the magnetite particles expands progressively towards the low-pressure end of the magnetite slug. The expanding gas carries the particles at the low-pressure end of the slug with it, thus reducing the effective length of the slug able to generate frictional forces at the tube wall and causing the progressive fluidising of the slug. The slug experiences a collapsing normal force on the tube wall and a resulting decrease in frictional force. This intersticular gas expansion and resulting magnetite particle drag propagates through the magnetite slug until the high pressure side of the blockage shears the remaining blockage and a scouring flowpath is established. Once a flowpath is established sufficient gas velocity exists for the magnetite particles to be swept from the bend and ejected from the boiler.

Several conditions need to exist for the slug to be successfully removed:

(a) the magnetite blockage must have sufficient air gaps among neighbouring particles to permit a compressed gas to be stored and suddenly released. The nature of the outer layer of shed magnetite is flake-like and thus permits large air gaps amongst particles;

(b) successive attempts at pressurisation/depressurisation may be required for a slug to be sufficiently fluidised and a flowpath through the blockage to be established. Short lengths of magnetite slugs require less depressurisations for the establishment of a flowpath. It is expected that the nature and length of magnetite blockages for a certain boiler be known and the number of repeated depressurisations required to successfully remove all exfoliated magnetite are to be empirically arrived at. Filter paper samples on the boiler exit pipework will enable proof to be gained that all exfoliated material has been expelled;

(c) a sudden pressure drop is required for the intersticular expansion to be effective in transporting magnetite particles. This requires a large drain nearby the magnetite blockage and a quick acting release valve. As a guide, the drain area should preferably be at least ⅓ the area of the common headers to promote unrestricted flow.

EXAMPLE 1

Figure 3:
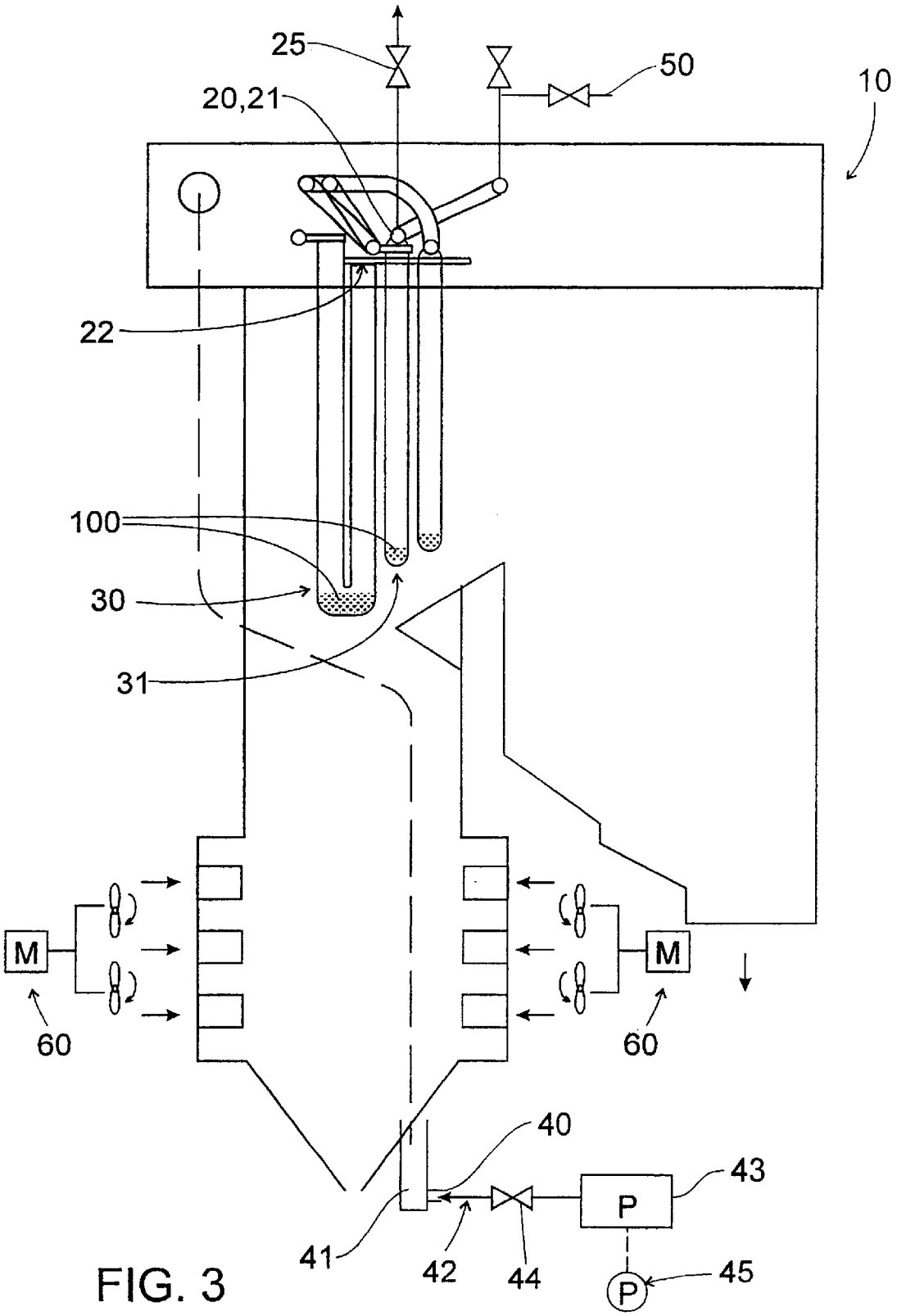
FIG. 3 is a schematic layout drawing of the forced cooling and magnetite purging system of the present invention.

A preferred embodiment, as applied to a 350MW Unit at Callide B Power Station, will now be described with reference to FIG. 3:

The tertiary superheater header cap was replaced on the unit 10. This permitted a 190 mm OD drain stub to be accessed on a 313 mm ID common header. A purpose designed, pressure and temperature rated bolted boiler inspection cap 20 was fitted to the header 21 to aid in accessing the drain without any need for cutting, re-welding or x-raying of the header each time a purge was required. The pendant loops 31 immediately before the common header 21 are the most significant site for the accumulation of exfoliated magnetite 100. The secondary superheater 1 pendants 32 also contain exfoliatable magnetite 100. One downcomer removable inspection cap 40 was installed on a 126×13 mm WT inspection stub 41 to permit the fitting of a 100 mm NB airline 42 connected to compressor(s) 43 via gas flow valve 44.

In the event of a unit outrage where the superheater tubes 30, 31 would be cooled below 150° C. and magnetite exfoliation is expected, the boiler 10 is fired down to 1000 KPa where drum metal temperatures are approximately 200° C. and superheater header temperatures are characteristically 400° C. when steam flow ceases. The master fuel trip is initiated at this 1000 KPa pressure, all fan groups 60 are stopped and superheater attemperators and feedwater control valves are isolated. At this pressure, the waterwall and economiser drains are opened to expel the water/steam. Once all steam pressure has been lost and water has stopped flowing from the waterwall/economiser drains, the HP bypass valves 50 are opened and LP bypass valves cracked open. The air extraction pumps on the condenser draws a small vacuum from the boiler side. Waterwall floor drains and air releases on the superheater headers 22 are opened to determine that a small vacuum exists in the steam space. This vacuum permits personnel to work in safety while removing the inspection caps. Additionally, wet steam is drawn out of the boiler 10.

The downcomer cap 40 is removed and a 1000 NB air line 42 fitted in its place. The tertiary superheater header inspection cap 20 is removed and replaced with a 400° C. temperature rated 300 mm NB quick opening butterfly valve 25. The vacuum on the boiler 10 is stopped, all drains, and valves (including the HP bypass valves 50) are closed except for the tertiary superheater outlet header quick acting valve 25 and downcomer inlet cap air line 42. If the tertiary superheater tubes 30, 31 are the only site for magnetite exfoliate 100, compressed air at approximately 2500 CFM at 670 KPa is admitted through the downcomer inlet cap 40 and regulated to approximately 500–650 KPa by the tertiary superheater quick acting valve 25. This permits a flow velocity of 4.5 m/s in all parallel paths of the tertiary superheater 31. The terminal velocity of magnetite flakes has been experimentally determined to be approximately 4.0 m/s for 90% of all flakes. Callide B boilers have begun to see some exfoliation of the secondary superheater 1 elements 30. To establish 4.5 m/s air velocities through these elements, a 4500 CFM air supply is required.

Once the exiting air from the boiler 10 is dry, the fan groups 60 can be restarted and draft group air flow can be established near maximum rate (400 Kg/s). Cooling rates on header temperatures can be regulated by draft or compressed air pressures and flows. Once metal temperatures of boiler tubes 30, 31 containing exfoliating magnetite 100 are below 50° C., magnetite exfoliation in tube bores should be complete. The boiler cool out process is then applied to the Reheater system by closing off the tertiary superheater quick acting valve 25 and opening the HP bypass valves 50 and LP bypass valves. This provides cooling air to be expelled through the condenser.

Approximately fifteen hours of compressed air and draft group flows are required for the above process to be complete.

The above steps seek to:

(a) avoid wet steam condensing and blocking Superheater/Reheater loops;

(b) carry dry exfoliated magnetite flakes from the boiler before a loop blockage can occur;

(c) force cool the boiler to lessen the time for access to the boiler (in the event of maintenance being required);

(d) cause the magnetite exfoliation step to be complete as soon as possible so that an air purge may be initiated; and (e) dry out the boiler for possible storage, limit the occurrence of flash rusting on tube and header bores, and remove wetness from the boiler so that exfoliated magnetite flakes do not tend to continue to adhere to the tube bore due to water surface tension.

The dry gas flow must continue until boiler tube metal temperatures are reached which are below that where the exfoliation mechanism is no longer active (approximately 50° C). The dry gas can be expelled from the boiler through drains, the condenser space and/or temporary inspection caps. It can further be considered to have the dry gas at a high pressure to permit a superior heat transfer between the tube walls and the gas.

Further cooling capacity can be achieved through the operation of the forced draft and induced draft fan groups. Consideration must be given to control the rate of header temperature decline so as to avoid excessive stress. Control can be achieved by limiting the dry gas flow pressure, lowering the draft group fan flow and/or decreasing the amount of dry gas being admitted to the steam path (this may cause gas flows to fall below the pressure head required to suspend a magnetite flake).

Preferably, the dry gas should be introduced into the coldest parts of the water/steam path so as to avoid excessive thermal stress on thick metal components. Removable lower waterwall header caps or drum downcomer inspection caps can be utilised.

Callide Power Station's 350MW boilers use 127 cubic meters per minute of 600 KPa compressed air to controllably force cool and remove exfoliating magnetite from the boilers. 400 kg/s of gas path draft fan group flow is used in conjunction with the compressed air. These mediums are capable of cooling all boiler metal temperatures (including headers and drums) to less than 50° C. in 15 hours from master fuel trip. This compares with normal convective cooling with draft groups gas path flow requiring 156 hours for all headers to be below 100° C.

Once magnetite exfoliation is complete and it is suspected that magnetite tube blockages may exist in the boiler, the compressed air supply 43 is isolated and the fan draft groups are stopped. The temporary valve 25 is closed and the boiler 10 is made tight. Compressed air is again admitted through the downcomer inspection cap 40 (via airline 42/valve 43) and the boiler steam space is filled to the operating pressure of the compressed air system. This is nominally 650 KPa. Once this pressure is attained, the temporary butterfly valve 25 is opened. Opening time should be less than 0.5 seconds. The pressure in the tertiary superheater common header 21 drops to near atmospheric pressure, and a large pressure differential is experienced across parallel pendant paths 30, 31. This produces the motivating mechanism for magnetite slug removal (as described with reference to FIG. 2 above).

Once the nominated number of air purges has been completed and all exfoliated magnetite 100 has been removed from the boiler tubes 30, 31, the tertiary superheater header cap and downcomer inspection cap are re-fitted and the boiler 10 can be returned to service.

Where the air compressors cannot supply air to a pressure of, eg., 1200 KPa, the boiler can be pressurised to, eg., 650 KPa and be further pressurised by water displacing the air, to 1200 KPa, from the boiler feed pump 45.

EXAMPLE 2

During an outrage of Callide B Unit 1, a 3000 CFM air supply was admitted to the boiler steam path to aid the removal of magnetite as it exfoliated from the boiler tubes 30, 31 and to force cool the boiler 10 to permit reduced access time. The expected magnetite shedding of the tertiary superheater loops 30, 31, using a traditional rundown procedure, would contain an average of 35–65% cross-section filled with magnetite. An x-ray of all 192 tertiary superheater bends after the forced cool air flow had been applied revealed only one bend contained any magnetite. This bend had 30% blockage and contained water (from a leaking high temperature attemperator).

This occurrence illustrates the importance of ensuring no condensate accumulates in the steam path during the cool out phase. The remaining 191 parallel paths of the tertiary superheater were free from exfoliated magnetite. Approximately 30% of secondary superheater 1 bends had 10–25% of the cross-section blocked with exfoliated magnetite 100. To have the secondary superheater 1 loops clear of magnetite during the rundown/coolout, 4500 CFM of compressed air was required. At the time of the unit rundown, only 1.8 compressors (3700 CFM) were available. Normally, 5670 CFM of compressed air is available.

To test the effectiveness of the pressurising air purge, two 35 mm radius Tertiary Superheater pendant bends were cut, filled and tamped down with dry magnetite for 260 mm and 480 mm (lineal length). The bends were at the extreme end of the header away from the installed 190 mm ID drain. This magnetite removal test in the Tertiary Superheater was believed to be more arduous than would ever be experienced on the Callide Units (both in terms of quantity of material and dry compaction to remove air space). One air purge was completed at an initial pressure of 550 KPa. A magnet was used to determine that the two fully blocked test bends still had magnetite present. A second air purge at an initial pressure of 650 KPa cleanly removed all of the magnetite from the test bends. X-rays immediately after this 650 KPa air purge showed no traces of magnetite in any of the 22 tertiary superheater and secondary superheater bends examined.

The traditional method of cutting and cleaning substantially blocked pendant bends requires 10 days loss of Callide B Unit availability per boiler cool out. Force cooling a boiler using compressed air to remove falling magnetite, and air purging any exfoliated magnetite from Superheater bends requires approximately 18 hours from master fuel trip. Re-firing of the boiler can occur immediately after this time.

It will be readily apparent to the skilled addressee that the present invention enables a faster cool down of boilers, with the likelihood of exfoliated magnetite blockages being minimised (if not eliminated), and that any such magnetite blockages can be quickly and effectively purged.

Various changes and modifications may be made to the embodiments described and illustrated without departing from the present invention.

What is claimed is:

1. A method of controllable force cooling a boiler and removing exfoliated magnetite from at least one boiler heater tube in the boiler, the method including the steps of:

after the boiler is fired down, depressurised and drained of water, and while the temperature(s) of the boiler tube(s) exceeds the temperature at which magnetite exfoliates, introducing a dry gas flow into the boiler water/steam side of the boiler to (i) initially remove wet steam and prohibit condensation collecting in superheater heater loops in the boiler heater tube(s), and (ii) then promote the dry gas flow in the boiler heater tube(s) where magnetite exfoliation exists, where the flow velocity of the dry gas exceeds the terminal velocity of flakes of the magnetite exfoliated so as to cause the flakes to be expelled from the boiler.

2. A method as claimed in claim 1 wherein:

the boiler tube temperature is above 150° C.

3. A method as claimed in claim 1 wherein:

preferably the flow velocity of the dry gas exceeds 4.5 m/s.

4. A method as claimed in claim 1 wherein:

the dry gas flow is maintained, in step (ii), until the boiler tube(s) temperature are below the temperature at which magnetite exfoliation occurs.

5. A method as claimed in claim 4 wherein:

the boiler tube(s) temperature(s) are below 50° C.

6. A method as claimed in claim 1 wherein:

the dry gas flow is at high pressure to promote surface heat transfer between the wall(s) of the boiler tube(s) and the dry gas.

7. A method as claimed in claim 1 wherein:

the dry gas is introduced into the coldest portions of the boiler tube(s) to minimise thermal stress.

8. A method as claimed in claim 1 wherein:

the dry gas is air, nitrogen, dry steam, oxygen, carbon dioxide or two or more of these in a mixture.

9. A method for removing magnetite blockage(s) from at least one boiler tube in a boiler, including the steps of:

a) operably connecting a quick opening valve to the boiler tube(s);

b) slowly pressurising the boiler tube(s) with dry gas, enabling the dry gas to be entrained between the flakes of the magnetite during the pressurisation phase; and c) rapidly opening the valve to cause a negative gas pressure transient to propagate back to the magnetite blockage(s), to cause the magnetite blockage(s) to be fluidised and be drawn out the boiler tube(s) by flow of the dry gas out the valve.

10. A method as claimed in claim 9, wherein:

steps (b) and (c) are repeated one or more times to remove all the magnetite.

11. A method according to claim 9, wherein:

the boiler tube(s) are pressurised to 650–1200 Kpa.

12. A method according to claim 9 wherein:

the dry gas is initially compressed by 650 Kpa and is further compressed by water pumped through boiler feed pump(s).

13. A method according to claim 9 wherein:

in step (c), the valve opening time is no longer than 0.5 seconds.

14. Apparatus for the controllable force cooling of a boiler and for removal of exfoliated magnetite from at least one boiler heater tube in the boiler, the apparatus including:

a source of pressurised dry gas;

means to connect the dry gas source to the boiler tube(s); and a quick-operating valve operably connected to the boiler tube(s), the valve being operable to allow a flow of the dry gas, while the temperature of the boiler tube(s) exceeds the temperature at which magnetite exfoliates gas, through the boiler tube(s), at a flow velocity exceeding the terminal velocity of flakes of the exfoliated magnetite, to cause the flakes to be expelled from the boiler.

15. Apparatus for removing magnetite blockage(s) from at least one boiler tube in a boiler, including:

a quick-operating valve connected to the boiler tube(s); and means to slowly pressurise the boiler tube(s) with dry gas, enabling the dry gas to be entrained between flakes of the magnetite during the pressurisation phase; so arranged that, on rapidly opening the valve, a negative gas pressure transient is propagated to the magnetite blockage(s) to be fluidised and be drawn out of the boiler tube(s) by the flow of dry gas out the valve.

16. Apparatus according to claim 15 wherein:

the means to pressurise the boiler tube(s) includes at least one gas compressor operably connected to the boiler tubes by a gas flow valve.

17. Apparatus according to claim 15 wherein:

the means to pressurise the boiler tube(s) includes at least one air compressor, operably connected to the boiler tubes, by a gas flow valve, the air compressor(s) pressurising the gas to a first pressure, and at least one boiler feed pump operably connected to the gas flow valve to pressurise the gas to a higher pressure.

* * * * *